United States Patent [19]

Petersen

[11] 4,122,511

[45] Oct. 24, 1978

[54] LAMP-SHADE FOR TUBULAR LAMPS

[76] Inventor: Jann Petersen, Rytterbakken 34, Greve Strand, Denmark

[21] Appl. No.: 770,936

[22] Filed: Feb. 22, 1977

[30] Foreign Application Priority Data

Feb. 20, 1976 [DK] Denmark ..... 703/76

[51] Int. Cl.[2] ..... F21V 1/00

[52] U.S. Cl. ..... 362/351; 362/223; 362/260; 362/354; 362/359

[58] Field of Search ..... 362/351, 354, 359, 360, 362/361, 223, 260

[56] References Cited

U.S. PATENT DOCUMENTS

| | | | |
|---|---|---|---|
| 2,724,047 | 11/1955 | Zurawski | 362/260 |
| 2,990,763 | 7/1961 | Frant z | 362/223 |
| 3,169,710 | 2/1965 | Lipscomb | 362/260 |
| 3,179,797 | 4/1965 | Franck | 362/223 |

*Primary Examiner*—Samuel W. Engle
*Assistant Examiner*—Donald P. Walsh
*Attorney, Agent, or Firm*—Spencer & Kaye

[57] ABSTRACT

A lamp-shade for tubular lamps of outer diameter *d*, comprising two longitudinally extending, in cross sections evenly concavely curved, light reflecting side shade-faces facing each other and arranged on each side of a middle plane containing the axis of the lamp. The shade further comprising a number of light reflecting cross plates extending between the two side shade-faces evenly spaced along the length of the shade. The distance between the lamp and a plane through the lower edges of the side shade-faces being between 1.7 *d* and 3 *d*. Each side shade-face being evenly curved from an uppermost portion situated at a level higher than that of the upper side of the lamp and having a minimum distance from said middle plane not exceeding 0.6 *d* to the lower edge and is near the latter touching a plane parallel to the middel plane in a distance therefrom of between 1.3 *d* and 3 *d*. The lower border zone of each side shade-face having a height of between 0.2 *d* and 0.3 *d* and is being slightly converging towards said middle plane.

8 Claims, 5 Drawing Figures

LAMP-SHADE FOR TUBULAR LAMPS

FIELD OF THE INVENTION

This invention relates to a lamp shade adapted for being arranged directly on a tubular lamp, preferably on a tubular fluorescent lamp, having an outer diameter *d*, which shade comprises a housing defining two longitudinally extending, in cross sections concavely curved, light reflecting side shade-faces facing each other and arranged on each side of a middle plane of the shade, which middle plane, when the shade is arranged on a tubular lamp, contains the longitudinal axis of the lamp, a number of cross-plates extending between said two side shade-faces, and each being light reflecting on each side facing another one of said cross-plates and retaining means adapted to retain the lamp shade on a corresponding tubular lamp in such a position that when the lamp shade is mounted on a horizontal corresponding tubular lamp the uppermost portions of said two side shade-faces are situated at a level higher than that of the uppermost part of said lamp.

BACKGROUND OF THE INVENTION

For example, from British patent specification No. 819,549 such a lamp shade is known, in which two separate side shade plates defining the side shade-faces are arranged with an upper mutual distance of more than 2 *d*. The said shade plates are at their upper edges provided with inwardly extending, downwardly bowed retaining tongues adapted to rest on the tubular lamp. Each side shade-face has in cross sections an upper outwardly extending approximately plane portion that through a bow continues into a downwardly extending part following such a slightly curved curve that the said parts of the shade-faces diverge over their whole height. The shade is relatively shallow so that when the shade is arranged on a tubular lamp a plane through the lower edges of the side shade-faces will be situated at a distance from the lamp of the same order of magnitude as *d*.

Such a shade provides an acceptable protection against glare in its transverse direction as well as in its longitudinal direction, the latter owing to the cross-plates, but it permits only utilizing of theoretically at a maximum 70% of the light emitted from the tubular lamp, and in practice much less than that. Further the direct downwardly emitted light from the lamp together with the light reflected from the lamp shade provides a highly irregular dispersion of the light, resulting in a relatively powerfully illuminated zone directly below the shade and relatively wide essentially more badly lit border zones.

Somewhat the same is the case in connection with the lamp shade known for example from the German published patent application No. 2,410,037 and also adapted for being arranged directly on a tubular lamp. This known shade comprises a half cylindrical retaining plate embracing the upper half of the lamp from which retaining plate the real shade plates defining the side shade-faces extend. The cross sections of these side shade-faces follows a parabola, and the plane through the lower edges of the side shade-faces is situated at a relatively short distance from the lamp of between *d* and 1.5 *d*. Owing to the retaining plate, such a shade permits only utilizing less than 50% of the light emitted from the tubular lamp. Since this known shade is not provided with cross-plates it does not protect against glare in the longitudinal direction of the tubular lamp.

OBJECTS OF THE INVENTION

It is the principal object of the invention to provide a lamp shade of the type concerned that ensures utilization of at least 75% of the light emitted from the tubular lamp and nevertheless ensures an effective protection against glare in the transverse as well as in the longitudinal direction of the tubular lamp and which shade is able simultaneously to ensure such a uniform illumination of the area illuminated by the lamp that for obtaining the same degree of illumination the mutual distance between neighbouring lamps may be made essentially greater than hitherto has been possible even by use of unprotected tubular lamps. Thus another object of the invention is to provide a lamp shade for tubular lamps rendering it possible in a room illuminated by tubular lamps provided with such shades to reduce the number of lamps compared with what previously has been necessary so that an essential saving in energy may be obtained.

SUMMARY OF THE INVENTION

These objects and others, according to the invention, are attained by the height of the shade being such that when the shade is mounted on a horizontal tubular lamp, the distance between the lower most part of the outer face of the latter and a plane through the longitudinally extending lower edges of the two side shade-faces is between 1.7 *d* and 3 *d*, and by each side shade-face following a smooth curve having at levels above last said lamp a minimum distance from said middle plane not exceeding 0.6 *d* and touching at its lower part a plane parallel to said middle plane of the shade at a distance therefrom of between 1.3 *d* and 3 *d*.

Owing to said curve being smooth together with the fact each side shade-face extends to a position at a higher level than the uppermost part of the lamp and here has a distance from the middle plane at the highest only a little more than 0.5 *d*, only a very limited amount of the light emitted from the upwardly facing portion of the tubular lamp is not caught by the side shade-faces and by reflection utilized for illuminating the area below the shade, and the relatively great height of the shade in connection with the described shape of the side shade-faces produces the result that the illuminated area below the shade, although having a somewhat smaller width than by use of hitherto known shades, owing to directly emitted light as well as reflected light will be so powerfully and uniformly illuminated that only a very narrow border zone of the illuminated area demands to be overlapped by light from another lamp for ensuring a uniform illumination of the whole area. It is owing to these very narrow border zones that the distance between neighbouring lamps may be made essentially greater than hitherto possible for obtaining the same minimum illuminating power per unit of area.

Preferably each side shade-face comprises a lower border zone extending below the portion of the shade-face touching the above said plane parallel to the middle plane and converging towards the latter. Especially if the height of said border zone is between 0.2 *d* and 0.7 *d*, a further narrowing of the insufficiently illuminated border zones of the area illuminated will be obtained.

It is possible to use a housing consisting of a single bowed shade plate in which case the retaining means may be constituted by holes in the cross-plates. More appropriately however, according to a further feature of the invention the housing comprises two separate side shade plates defining the side shade faces and being provided with upper edge faces having a mutual distance greater than *d*, but less than 1.2 *d*, preferably less than 1.1 *d*, and so arranged that a plane through the lower edges of said upper edge faces, which edges limit the side shade-faces, extends above the lamp, preferably at a distance therefrom of not less than 0.03 *d*. Hereby is obtained not only that the lamp shade may be arranged on the tubular lamp after the latter has been inserted in its socket, but also that this suspension manner may be used without more than an insignificant part of the upwards emitted light from the tubular lamp being lost, since even the uppermost parts of the side shade-faces may be utilized for obtaining a downwards reflection of the light.

In this case the retaining means may be constituted most appropriately by flexible retaining members connected to at least two of the cross shade-plates at the upper edges thereof, whereby the mounting of the shade becomes much easier than when the retaining means are connected to the side shade plates.

According to a still further feature of the invention, the upper edges of the cross-plates are arranged at a lower level than that of the lowermost part of a tubular lamp on which the shade is adapted to be mounted, whereby it has been shown that the luminous yield from the lamp with a shade becomes essentially greater than would be the case if, as previously known, the cross-plates surround most of the lamp. Possibly this result is because the smoothly curved side shade-faces are able to provide for downwards reflection of light even when the light is not radially emitted, whereas otherwise such light would have to be reflected a number of times by the cross shade plates, so that with each reflection luminous power is lost.

It has been proven that the cross-plates, which are necessary for obtaining protection against glare in the longitudinal direction of the shade and also for supporting the side shade plates relative to each other when their light reflecting side faces are plane, will cause a reduction of the illuminating force compared with the illumination that may be obtained if no cross shade plates are used. It has been shown, however, that provided otherwise the lamp shade is embodied as stated above, this reduction of the light emission may be reduced, if the distance between the cross shade-plates is of the same order of magnitude as the width of the shade measured between the lower edges of the side shade-faces, and each light reflecting side of each cross shade-plate is serrated in cross sections parallel to the middle plane of the shade by being provided with downwards facing inclined faces interconnected by short transverse faces approximately parallel to the plane through the lower edges of the two side shade faces.

DESCRIPTION OF THE DRAWING

The above and other objects, features and advantages of the present invention will become more readily apparent from the following description, reference being made to the accompanying drawing in which.

DETAILED DESCRIPTION

Figure 1:
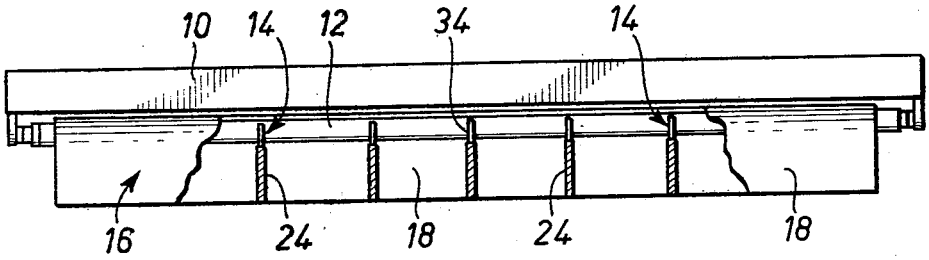
FIG. 1 is a side elevational view of a tubular fluorescent lamp arranged in a conventional lighting fitting and provided with an embodiment of a lamp shade according to the present invention, a portion of the one side shade plate facing the viewer being broken away.

In FIG. 1, 10 indicates a main light fitting for a tubular fluorescent lamp 12 on which a lamp shade 16 is suspended by means of clamping members 14. The shade 16 has a length corresponding to the length of the portion of the lamp 12 emitting light.

Figure 2:
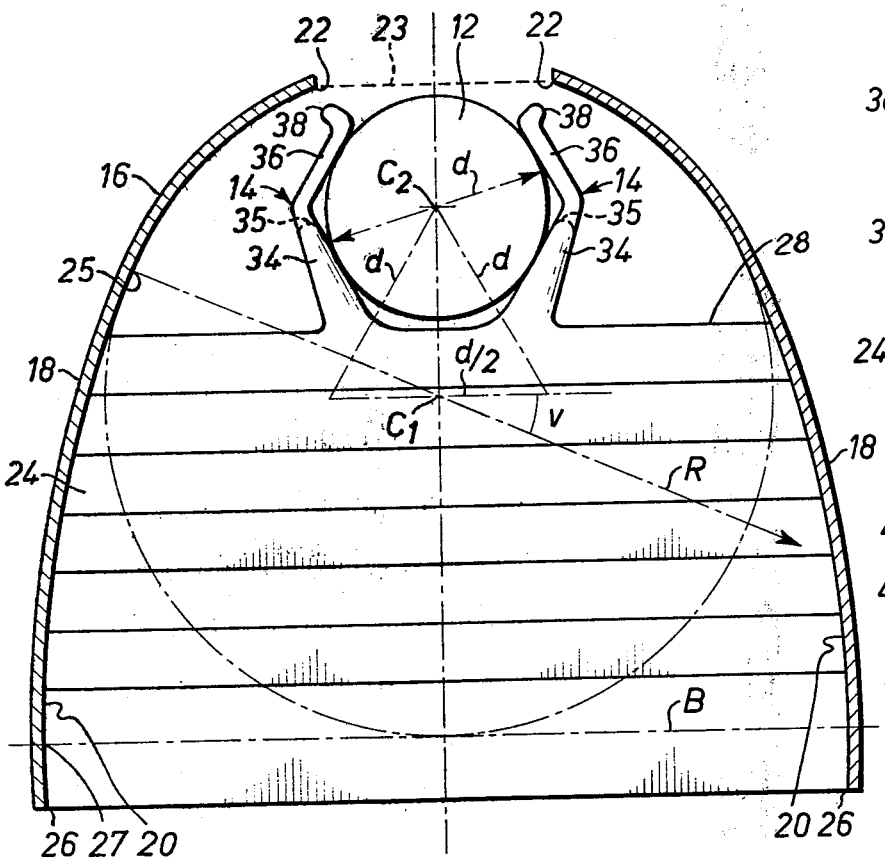
FIG. 2 is a cross sectional view in a larger scale through the lamp shade shown in FIG. 1.
Figure 3:
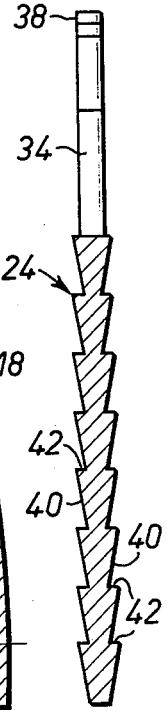
FIG. 3 is a cross sectional view in the same scale as FIG. 2 through a cross-plate of the lamp shade shown in FIGS. 1 and 2.

The form of the shade 16 appears more distinctly from FIGS. 2 and 3. The lamp shade shown is provided with a housing comprising two curved side shade plates 18, the concave inner shade-faces 20 of which are facing each other. The shade plates 18 may be made for example from a relatively hard plastic, such as polystyrene, that is metallized on its inner side, so that the inner shade-faces 20 are strongly light reflecting. Each inner shade-face 20 ends at its upper end with a longitudinal edge 22. The two edges 22 have a mutual distance that is a little, for example 4 to 10%, but not more than 20%, greater than the diameter *d* of the tubular lamp 12, and the plane 23 interconnecting them has a distance from the longitudinal axis $C_2$ of the lamp 12 corresponding to half the said distance between the edges 22. Although the lamp 12 does not constitute any part of the present invention or the lamp shade shown, it has been found most appropriate to show the same also in FIG. 2.

As shown in FIG. 1, the two side shade plates 18 are interconnected by a number of cross-plates 24, which are evenly distributed along the length of the lamp shade 16. The mutual distance between two neighbouring cross-plates 24 corresponds to and is at least of the same order of magnitude as the distance between the lower edges 26 of the two side shade-faces 20.

The shade 16 has a height that is a little less than its width measured between the edges 26 and corresponds most appropriately to between 3 *d* and 4 *d*.

The upper edge 28 of each cross-plate 24 is arranged below the lamp 12 at the same distance from the lamp axis $C_2$ as the plane 23.

Each cross-plate 24 is provided at the center portion of its upper edge 28 with two outwardly inclined supporting rods 34 extending near the outer surface of the lamp 12 and ensuring that the shade 12 is kept in the correct lateral position relative to the lamp 12. On a cross-plate 24 near each end of the shade 16 each supporting rod 34 is provided with an extension 36 forming an angle with the supporting rod. These extensions are so thin that they are flexible and they serve by abutment of the lamp 12 to retain the lamp shade 16 on the tubular lamp 12. The extensions 36 end in outwardly inclined end members or guide members 38 which serve to facilitate the placing of the lamp shade 16 on the lamp 12 and the later removal of the shade.

The cross plates 24, including the two cross plates 24 located at each end of the shade plates 18, are metallized, or in another known manner provided with strong light reflecting properties, on their side surfaces which face one another. Moreover, as shown in FIG. 3, each of these reflecting surfaces is serrated or saw tooth shaped in cross section and includes a plurality of downwardly facing inclined faces 40 which are interconnected by short, approximately horizontal transverse faces 42. This saw-tooth shape results in the greatest downwardly directed reflection of light by the cross plates 24.

The side shade-faces 20 may, in cross sections, be shaped in many different ways provided care is taken that at the lower edge 26 of each side shade-face 20 or preferably at a small distance above this edge at the point 27, the side shade faces 20 touch, a plane parallel to the vertical middle plane of the lamp shade. Also most conveniently each side shade-face 20 ought below said point 27 be provided with a border zone converging towards the border zone of the opposite face 20.

Thus the side shade-faces 20 may follow an elipse or, owing to its more chubby ends, a super-ellipse having a vertical major axis of between 4.15 *d* and 10 *d*, and a minor axis of between 2.6 *d* and 6 *d*. Such an ellipse may most appropriately in the 1st quadrant have the equation: $(x/1.8\ d)^n + (y/3\ d)^n = 1$, in which $n$ is 2, 3 or 4.

Up to now, however, it has been found empirically that the best results are obtained by the shape shown in FIG. 2. In this case the cross section of each of the side shade-faces 20 is formed by two circular arcs 22–25 and 25–26. The arc 22–25 has its center $C_1$ at a distance from the center $C_2$ of the lamp 12 of $0.5\ d\sqrt{3}$ (the altitude of an equilateral triangle with the side length *d*). The radius of the arc 22–25 is defined by the point 22. The point 25 is defined by a line R forming an angle *v* with the horizontal of between 20° and 25°, in the embodiment shown of 22.5° (equal to 2 points). The intersection of the line R and a horizontal base line B, which is a tangent to the lowermost point of the circle defining the arc 22–25, is the center of the arc 25–26. As to the point 26, this point has to be situated on an extension of the circular arc 25–26 at a distance below the point where it intersects the basis line B, point 27, of between 0.2 *d* and 0.5 *d*. In the embodiment shown this distance is ⅔ of the distance between $C_2$ and the line R. After the latter having been explained it may be added, that the distance $C_2$-22 most conveniently is equal to the distance between $C_2$ and the line R.

Figure 4:
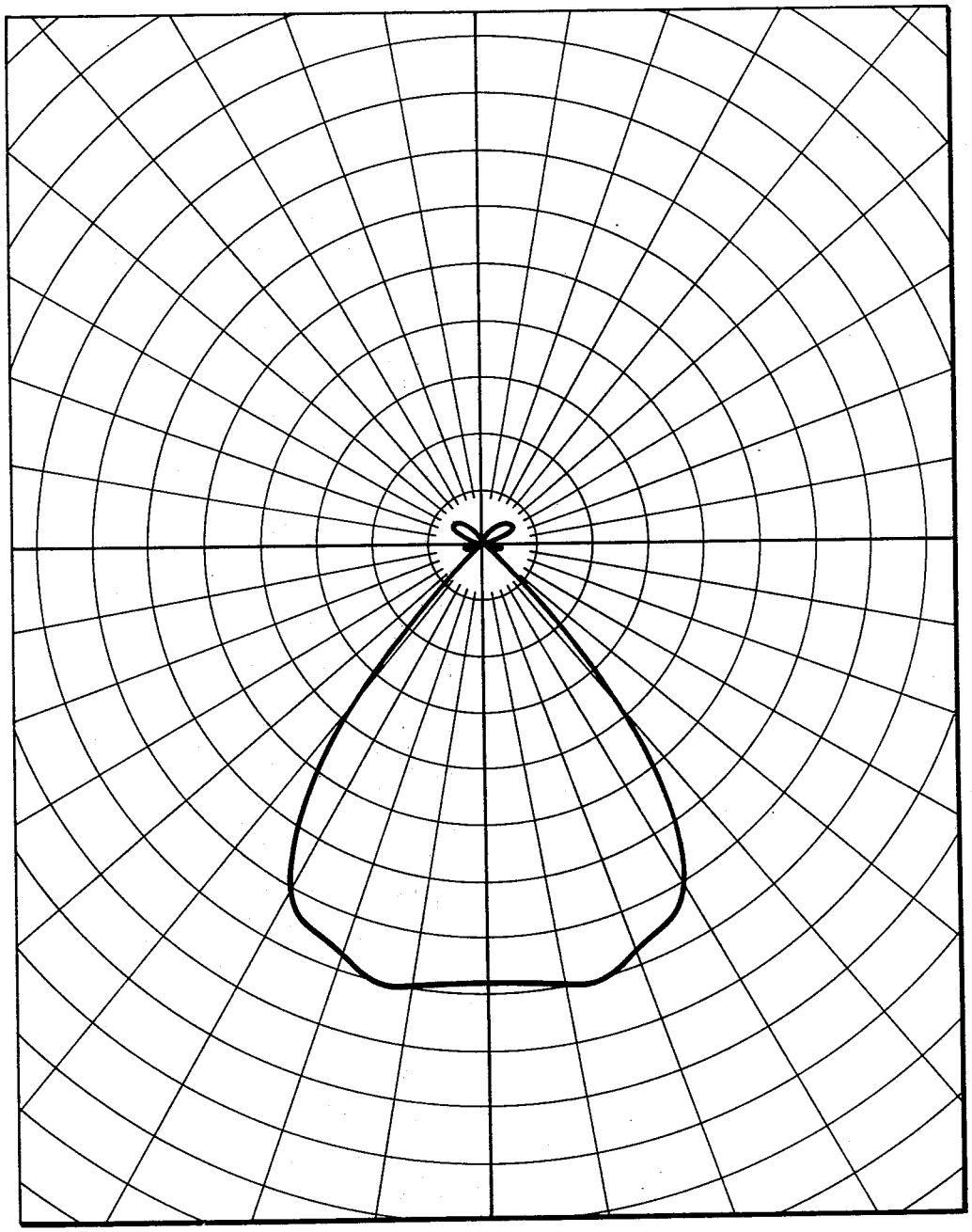
FIG. 4 is a graph showing the distribution of light from a tubular fluorescent lamp provided with a lamp shade as the one shown in FIGS. 1, 2 and 3.

The last said embodiment has been shown to ensure a very high yield of light from the lamp 12 and a very even dispersion of the light over the illuminated area. This appears, for example, from the light dispersion curve shown in FIG. 4 and originating from The Danish Illuminating Engineering Laboratory of Copenhagen, Denmark. It will be seen that the shade results in an extremely uniform and very powerful illumination of the entire area, that may be illuminated by use of the shade and with an efficiency that is more than twice the efficiency obtained by use of the same tubular lamp, but without any lamp shade at all. This is especially valid as far as amounts of lights emitted downwardly in directions between 20° and 30° with the vertical.

Figure 5:
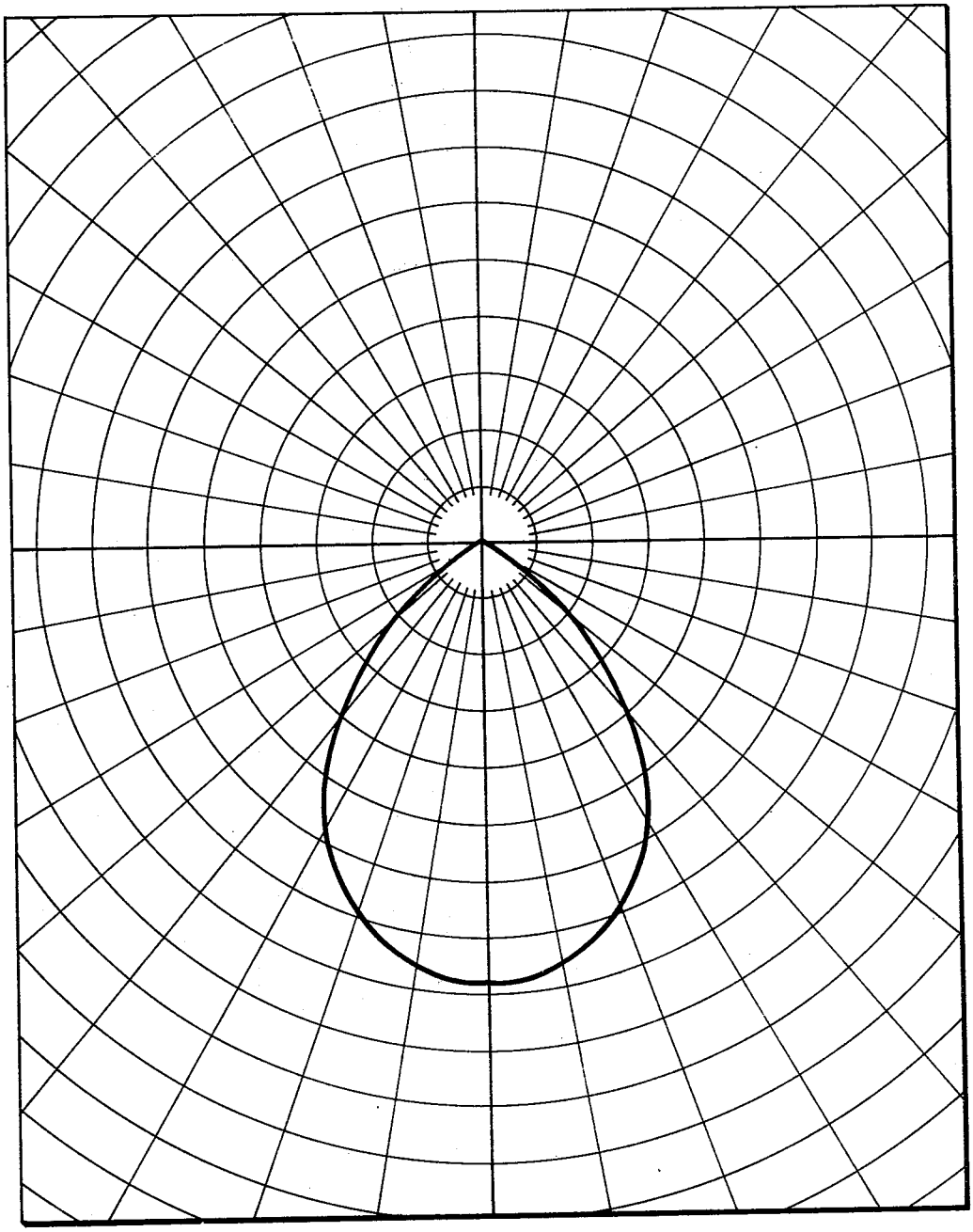
FIG. 5 is a corresponding graph of the distribution of light in the longitudinal direction of the lamp shade measured to the sides of vertical planes perpendicular to the tubular lamp through the ends of the shade.

FIG. 5 shows a corresponding curve of the light emission in the length direction of the lamp with a shade according to the invention. It has to be observed that the curve only covers areas outside vertical planes through the ends of the effective portion of the tubular lamp. From this curve appears the intensive spreading of the light over a relatively great angle of up to 30°.

It also has to be mentioned, that the tubular fluorescent lamp used for the examination of the effect of the lamp shade was of 40 Watt and had a diameter *d* of 37 mm. Also it should be mentioned that on the graphs shown in FIGS. 4 and 5 each graduation is equal to 50 cd/1000 lm.

The invention is not limited to the embodiment shown and explained but many amendments are possible within the scope of the following claims. Thus while each side shade plate 18 is shown with the same thickness over its whole height, the thickness thereof may vary over the height as well as over the length. Further it is not strictly necessary that the side shade-faces 20 are of one of the shapes explained above since even great deviations therefrom may result in improvement of the light distribution compared with what it is possible to obtain by use of hitherto known shades for tubular lamps. Still further, useful results are obtained even if the reflecting side faces of the cross-plates 24 are plane. The cross-plates 24 may be connected to the side shade plates 16 in many different manners, for example by cementing, welding or by use of rivets united with the cross-plates and penetrating holes in the side shade plates.

We claim:

1. In a lamp shade adapted for being mounted directly on a tubular lamp having an outer diameter *d*, said lamp shade comprising a housing defining two longitudinally extending, in cross sections concavely curved, light reflecting side shade-faces facing each other and arranged on each side of a middle plane of the shade, said middle plane containing, when the shade is arranged on a horizontally disposed tubular lamp, the longitudinal axis of the lamp, a number of cross-plates extending between said two side shade-faces and each being light reflecting on each surface of same facing another one of said cross-plates, said cross-plates together with said side shade faces defining free openings opposite the lamp for light emission from the shade, and retaining means for retaining the lamp shade directly on a tubular lamp in such a position that when the lamp shade is mounted on a horizontally disposed tubular lamp the uppermost portions of said two side shade-faces are situated at a level higher than that of the uppermost part of the lamp; the improvement wherein: the height of the shade is such that when the shade is mounted on a horizontally disposed tubular lamp, the distance between the lowermost part of the outer face of the lamp and a plane through the longitudinally extending lower edges of said two side shade-faces is between 1.7 *d* and 3 *d*; and each said side shade-face follows a smooth curve having at levels above said lamp a minimum distance from said middle plane not exceeding 0.6 *d* and touching at its lower part a plane parallel to said middle plane and having a distance therefrom of between 1.3 *d* and 3 *d*.

2. A lamp shade as defined in claim 1 wherein each of said side shade-faces has a lower border zone extending below said portion of said side shade-face touching the said plane parallel to said middle plane and converging towards the latter, said border zone having a height that measured parallel to said middle plane amounts to between 0.2 *d* and 0.7 *d*.

3. A lamp shade as defined in claim 1 wherein: said housing comprises two separate longitudinally extending side shade plates defining said side shade-faces, said side shade plates having upper edge faces, the lower edges of which define upper longitudinal edges of said side shade-faces, said upper edge faces having a mutual distance greater than *d*, but not exceeding 1.2 *d* and being disposed so that a plane through said upper longitudinal edges extends above said lamp.

4. A lamp shade as defined in claim 3 wherein said distance between said two upper edge faces is less than 1.1 *d*.

5. A lamp shade as defined in claim 3 wherein said plane through said upper longitudinal edges has a distance from said lamp of at least 0.03 *d*.

6. A lamp shade as defined in claim 3 wherein said retaining means are constituted by flexible retaining members connected to at least two of said cross shade plates at the upper edges thereof.

7. A lamp shade as defined in claim 1 wherein said cross-plates have upper edges arranged at a lower level than that of the lowermost part of the surface of the said lamp.

8. A lamp shade as defined in claim 1 wherein the distance between said cross-plates is of the same order of magnitude as the distance between said side shade-faces at the said lower edges thereof, each said light reflecting side face of each said cross-plate being serrated in cross sections parallel to said middel plane by being provided with downwards facing inclined faces interconnected by means of short transverse faces approximately parallel to said plane through said lower edges of said two side shade-faces.

* * * * *